US006685522B2

(12) United States Patent
Yun et al.

(10) Patent No.: US 6,685,522 B2
(45) Date of Patent: Feb. 3, 2004

(54) MAGNETIC FIELD MEASURING SYSTEM OF DEFLECTION YOKE

(75) Inventors: In Jung Yun, Suwon-shi (KR); Ho Jin Cho, Seoul (KR); Bong Woo Lee, Suwon-shi (KR); Byung Hoon Kang, Seoul (KR); Kwang Yun Choi, Uiwang-Shi (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 145 days.

(21) Appl. No.: 09/877,864

(22) Filed: Jun. 8, 2001

(65) Prior Publication Data

US 2002/0164915 A1 Nov. 7, 2002

(30) Foreign Application Priority Data

May 4, 2001 (KR) ..... 2001-24412

(51) Int. Cl.[7] ..... H01J 9/42

(52) U.S. Cl. ..... 445/3; 445/63; 445/26; 445/6; 445/24; 313/85; 313/370; 313/371

(58) Field of Search ..... 445/3, 26, 24, 445/25, 63, 6, 45; 315/8, 85, 284, 370, 371, 368

(56) References Cited

U.S. PATENT DOCUMENTS 3,731,138 A * 5/1973 Elias et al.
4,500,816 A * 2/1985 Murphy
4,612,482 A * 9/1986 Beamon, III et al.
5,066,891 A * 11/1991 Harrold et al.
5,367,221 A * 11/1994 Santy et al.

* cited by examiner

*Primary Examiner*—Dean A. Reichard
*Assistant Examiner*—Nguyen T. Ha
(74) *Attorney, Agent, or Firm*—Darby & Darby

(57) ABSTRACT

Disclosed is a product quality test in a winding step of the entire manufacturing process of a deflection yoke, which is a core part of a display device employing a cathode ray tube such as a color TV or a monitor, and in particular, a winding zig for measuring magnetic fields of a deflection yoke and a magnetic field measuring system of a deflection yoke using the winding zig. The winding zig and the system according to the invention include a plurality of magnetic field sensors mounted inside of the A-shaped winding zig, a digital signal generator for receiving output signals from the magnetic field sensors that sense magnetic field characteristics of a deflection coil wound around the A-shaped winding zig, amplifying the received signals, and converting the amplified signals to digital signals, a digital signal interface for converting the data outputted from the digital signal generator to serial data, and a transmitter for receiving signals processed as serial data by the digital signal interface, and transmitting the received signals.

14 Claims, 6 Drawing Sheets

( Prior Art )

( Prior Art )

( Prior Art )

( Prior Art )

MAGNETIC FIELD MEASURING SYSTEM OF DEFLECTION YOKE

BACKGROUND OF THE INVENTION

1. Field of the Invention

The present invention relates to a product quality test in a winding step of the entire manufacturing process of a deflection yoke, which is a core part of a display device employing a cathode ray tube such as a color TV or a monitor, and in particular, to a magnetic field measuring system of a deflection yoke that can predict screen characteristics in light of coil characteristics and can perform a total inspection of the coil characteristics and a coil grouping to enhance a product quality and a productivity by introducing a magnetic field measuring system in the process of manufacturing a horizontal deflection coil and a vertical deflection coil, which are core parts of a deflection yoke.

2. Description of the Prior Art

In general, the deflection yoke is classified into a saddle-toroidal type, a saddle-saddle type, etc., and functions to accurately deflect electron beams scanned from an electron gun to a fluorescent film coated on a screen of a cathode ray tube.

FIG. 1 shows a construction of a conventional deflection yoke. As shown in FIG. 1, a deflection coil 100 comprises a horizontal deflection coil and a vertical deflection coil, and functions to change the progressing direction of electron beams from a cathode ray tube (CRT) of a TV. Here, the horizontal deflection coil is seated around an internal periphery of a separator 200 formed in a horn shape, while the vertical deflection coil is seated around an external periphery of the separator 200.

The deflection coil 100 for horizontally and vertically deflecting the progressing direction of electron beams from a CRT is wound several times by a winding machine in a saddle shape so as to be seated on internal and external peripheries of the separator 200. FIG. 2 shows the deflection coil 100 comprising an upper flange 110 section including upper pinholes 111, a lower flange section 120 including a lower pinhole 121, and a body 130 located between the upper flange section 110 and the lower flange section 120.

Here, the upper pinhole 111 and the lower pinhole 121 function to smoothly adjust convergence by varying an inductance value and an impedance value to properly control the deflected degree of the electron beams.

The deflection yoke constructed as above is mounted on a neck of the CRT to deflect the electron beams R, G, B emitted from an electron gun of the CRT and determine the scanning positions of the electron beams on a screen, when a saw tooth wave pulse is applied to the horizontal deflection coil and the vertical deflection coil, and when magnetic fields are subsequently generated according to the Fleming's left-hand rule.

Here, the deflection force deflecting the electron beams R, G, B is mainly generated by the horizontal deflection coil and the vertical deflection coil among all the parts of the deflection yoke.

The horizontal and the vertical deflection coils play a significant role of realizing colors by receiving a signal from a control section of a display device and by deflecting the electron beams to desired positions. Of course, the quality as well as the functionality is a significant factor to be considered for evaluating a deflection yoke. Thus, it would be absurd to discriminate the parts of the deflection yoke in light of their functionality alone. However, it is obvious that the horizontal and vertical deflection coils perform the most essential function of the deflection yoke.

Therefore, it is one of the most important step in the entire process of manufacturing the deflection yoke to quantize the characteristics of the horizontal and the vertical deflection coils by using the relationship between the degree of generating the magnetic fields and the screen characteristics.

The process of manufacturing the horizontal and the vertical deflection coils, which are core parts of the deflection yoke in general, comprises the step of molding magnetic wires by means of a winding machine. Here, the winding machine includes a winding zig suitable for realizing the characteristics of diverse kinds of deflection yoke.

The quality of the coils manufactured through the above step can be evaluated by roughly measuring the magnetic fields or based on the screen characteristics after manufacturing the deflection yoke. However, the aforementioned two methods are capable of sampling tests only but insufficient to evaluate the entire products that have been manufactured. Further, the evaluation based on the screen characteristics has a drawback of failing to test the characteristics of the coils only due to the fabricating nature and influence of other minor materials.

In general, the conventional method of testing characteristics of the horizontal and the vertical deflection coils is to evaluate screen characteristics that is actually displayed after completing manufacture of the deflection yoke and to determine the coil characteristics based on the evaluated result. However, this method consumes a considerable period of time for manufacturing the deflection yoke, and subsequently increases the time for feeding back faults in its characteristics, if found any, thereby causing a managerial loss.

Under these circumstances, a compact managing method has been recently suggested to sample coils by using the relationship between the magnetic field characteristics and the screen characteristics, and to measure the magnetic fields of the sampled coils. If the measured magnetic fields are within a set standard, manufacture of the coils is proceeded with. However, this compact managing method has a limit of inspecting the sampling, thereby posing a problem of failing to prepare a proper countermeasure against a feasible dispersion in the manufacturing process.

SUMMARY OF THE INVENTION

It is, therefore, an object of the present invention to provide a magnetic field measuring system of a deflection yoke that is related to a product quality test in a winding step of the entire manufacturing process of a deflection yoke, which is a core part of a display device employing a CRT such as a color TV or a monitor, and in particular, to a magnetic field measuring system of a deflection yoke that can predict screen characteristics in light of coil characteristics and can perform a total inspection of coil characteristics and a coil grouping to enhance a product quality and a productivity by introducing a magnetic field measuring system in the process of manufacturing a horizontal deflection coil and a vertical deflection coil, which are core parts of a deflection yoke.

In other words, an object of the present invention is to introduce a coil measuring system into a winding system for manufacturing coils as well as to establish a system capable of a total inspection of coil characteristics by using the coil measuring system.

To achieve the above object according to one aspect of the present invention, there is provided a winding zig for measuring magnetic fields of a deflection yoke, comprising: a plurality of magnetic field sensors mounted inside of the A-shaped winding zig; a digital signal generator for receiving output signals from the magnetic field sensors for sensing magnetic field characteristics of a deflection coil wound around the A-shaped winding zig, and amplifying and converting the received signals to digital signals; a digital signal interface for converting data outputted from the digital signal generator to serial data; and a radio signal transmitter for receiving the signals processed to serial data by the digital signal interface, converting the received signals to radio signals, and transmitting the converted signals.

The digital signal generator in the winding zig for measuring magnetic fields of a deflection yoke comprises: amplifiers matched with each magnetic field sensor wound around the A-shaped winding zig for amplifying the signals sensed by the magnetic field sensors to a predetermined gain, and outputting the amplified signals; and A/D converters matched with each amplifier for converting the amplified signals to digital data.

According to another aspect of the present invention, there is provided a winding zig for measuring magnetic fields of a deflection yoke, comprising: a plurality of magnetic field sensors installed inside of the A-shaped winding zig; a digital signal generator for receiving output signals from the magnetic field sensors that sense magnetic field characteristics of a deflection coil wound around the A-shaped winding zig, amplifying the received signals, and converting the amplified signals to digital signals; a digital signal interface for converting the data outputted from the digital signal generator to serial data; an independent current source for supplying a driving current to drive the magnetic field sensors; a radio signal transmitter for receiving signals processed as serial data by the digital signal interface, converting the received signals to radio signals, and transmitting the converted signals; and an independent voltage source for supplying a driving voltage to drive the digital signal generator and the digital signal interface.

To achieve the above objects, there is also provided a magnetic field measuring system of a deflection yoke, comprising: a plurality of magnetic field sensors installed inside of an A-shaped winding zig; a digital signal generator for receiving output signals from the magnetic field sensors that sense magnetic field characteristics of a deflection coil wound around the A-shaped winding zig, amplifying the received signals, and converting the amplified signals to digital signals; a digital signal interface for converting the data outputted from the digital signal generator to serial data; an independent current source for supplying a driving current to drive the magnetic field sensors; a radio signal transmitter for receiving signals processed as serial data by the digital signal interface, converting the received signals to radio signals, and transmitting the converted signals; a radio signal receiving section for receiving magnetic field measuring data of a radio signal type transmitted through the radio signal transmitter; a data parallel processor for receiving the data received through the radio signal receiving section, converting the received data to parallel data, and processing the converted data by reference to a predetermined index in accordance with an associate relationship between screen characteristics and magnetic field values; and a liquid crystal display for visually displaying the data processed by the data parallel processor to an inspector or a worker.

According to another aspect of the present invention, there is provided a magnetic field measuring system of a deflection yoke, comprising: a plurality of magnetic field sensors installed inside of an A-shaped winding zig; a digital signal generator for receiving output signals from the magnetic field sensors that sense magnetic field characteristics of a deflection coil wound around the A-shaped winding zig, amplifying the received signals, and converting the amplified signals to digital signals; a digital signal interface for converting the data outputted from the digital signal generator to serial data; an independent current source for supplying a driving current to drive the magnetic field sensors; a radio signal transmitter for receiving signals processed as serial data by the digital signal interface, converting the received signals to radio signals, and transmitting the converted signals; a radio signal receiving section for receiving magnetic field measuring data of a radio signal type transmitted through the radio signal transmitter; a data parallel processor for receiving the data received through the radio signal receiving section, converting the received data to parallel data, and processing the converted data by reference to a predetermined index in accordance with an associate relationship between screen characteristics and magnetic field values; an image processing controller for receiving data processed by the data parallel processor, and realizing the processed data into images of three or two dimensions; and a liquid crystal display for visually displaying the images of three or two dimensions in accordance with an associate relationship between screen characteristics and magnetic field values to an inspector or a worker.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENTS

Figure 1:
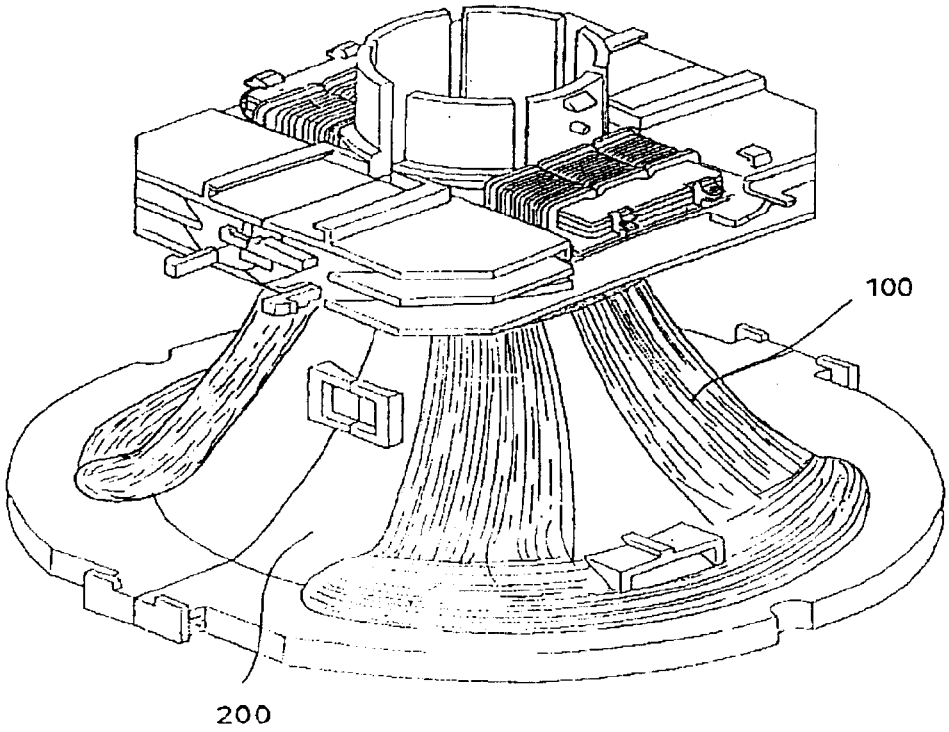
FIG. 1 is a perspective view of a separator comprising a conventional deflection coil.
Figure 2:
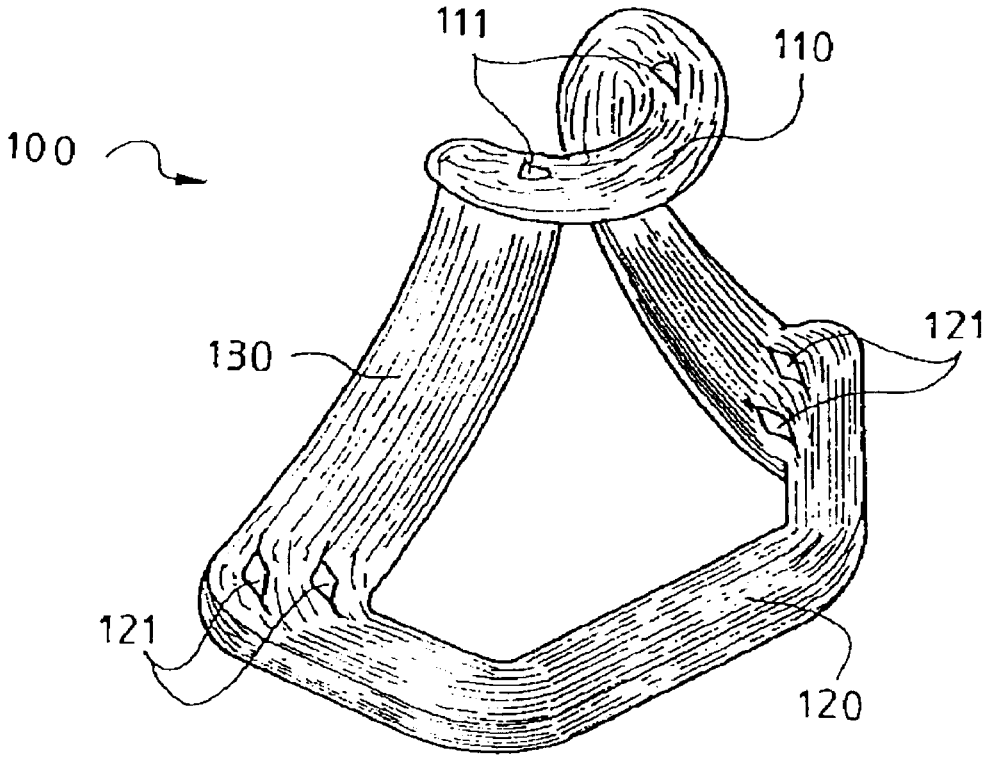
FIG. 2 is a perspective view of a conventional deflection coil.

Preferred embodiments of the present invention will now be described with reference to the accompanying drawings. In the following description, same drawing reference numerals are used for the same elements even in different drawings. The matters defined in the description are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

First to be described will be a brief comparison of the technical concept of the present invention with the conventional art.

Figure 3:
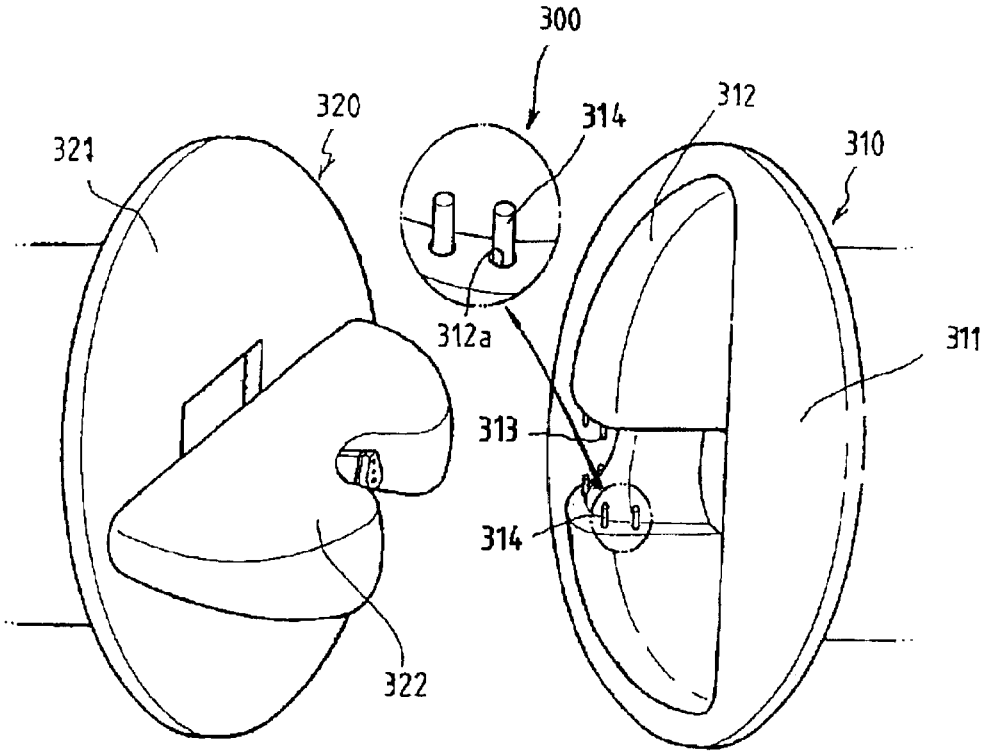
FIG. 3 is a diagram exemplifying a winding zig for winding a deflection coil.

FIG. 3 shows a deflection coil winding machine for winding a deflection coil 100. Referring to FIG. 3, the drawing reference numeral 300 identifies the deflection coil winding machine. The deflection coil winding machine 300 comprises a male winding mold (or an A-shaped winding zig) 310 and a female winding mold (or a B-shaped winding zig) 320 for leading a coil wound around a coil bobbin (not shown in the drawing), and turning and forming the lead coil to the deflection coil 100 of a saddle shape.

The male winding mold and the female winding mold identified by the drawing reference numerals 310 and 320 are also referred to as an A-shaped winding zig and a B-shaped winding zig as well. Both terms will be mixedly used in the following description.

Here, the male winding mold 310 comprises a male disk member 311 rotated by an external power source, and a male winding mold saddle 312 assembled with the male disk member 311. The female winding mold 320 comprises a female disk member 321 rotated by an external power, and a female winding mold saddle assembled with the female mold saddle 322.

An upper pin axis 313 and a lower pin axis, which are protruded and incoming through an axial hole 312*a* by an air cylinder to form an upper pin hole 111 and a lower pin hole 121 of the deflection coil 100, are respectively installed on corner surfaces of the male winding mold saddle 312.

Here, the axial hole 312*a* has a diameter identical to those of the upper pin axis 313 and the lower pin axis formed on the corner surfaces of the male winding mold saddle 312.

The following is a description of a winding operation of the deflection coil winding machine 300 constructed as above.

If the male winding mold 310 and the female winding mold 320 are rotated in an anti-clockwise direction by the external power source, the coil supplied through the coil bobbin turns around an upper flange section 110, a lower flange section 120, and a body section 130 forming a saddle shape between the male winding mold 310 and the female winding mold 320.

During the rotation of the male winding mold 310 and the female winding mold 320, the upper pin axis 313 and the lower pin axis 314 are protruded through the axial hole 312*a* by a pressure of the air cylinder. The upper pin hole 111 and the lower pin hole 121 are respectively formed in the upper flange section 110 and the lower flange section 120 of the deflection 100 by means of the upper pin axis 313 and the lower pin axis 314.

Figure 4:
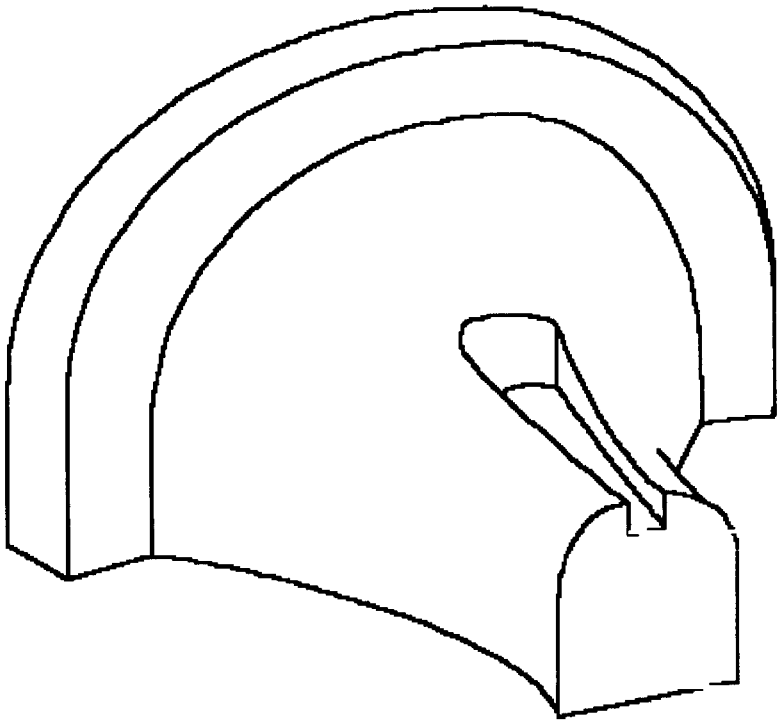
FIG. 4 is a diagram exemplifying a main part of an A-shaped winding zig among all types of winding zigs.

FIG. 4 is a diagram exemplifying a curved section of a conventional A-shaped winding zig.

Thus, the characteristic of the present invention lies in that characteristics of a horizontal deflection coil and a vertical deflection coil, which are essential parts of a deflection yoke, can be induced by continuing a predetermined current in a coil upon completion of winding of a deflection coil wound by a winding machine, measuring magnetic fields generated from the corresponding windings in numerous spots, and comparing the measured magnetic fields so as to predict screen characteristics and totally inspecting coil characteristics based on the coil characteristics only by introducing a magnetic field measuring system to a process of manufacturing the horizontal deflection coil and the vertical deflection coil. In the present invention, a plurality of magnetic field sensors MSa, MSb, MSn are mounted inside of the conventional A-shaped winding zig, as shown in FIG. 5.

Here, it should be noted that the drawing reference numerals MSa, MSb and MSn assigned to represent the magnetic field sensors do not have any particular meanings in terms of alignment.

Figure 5:
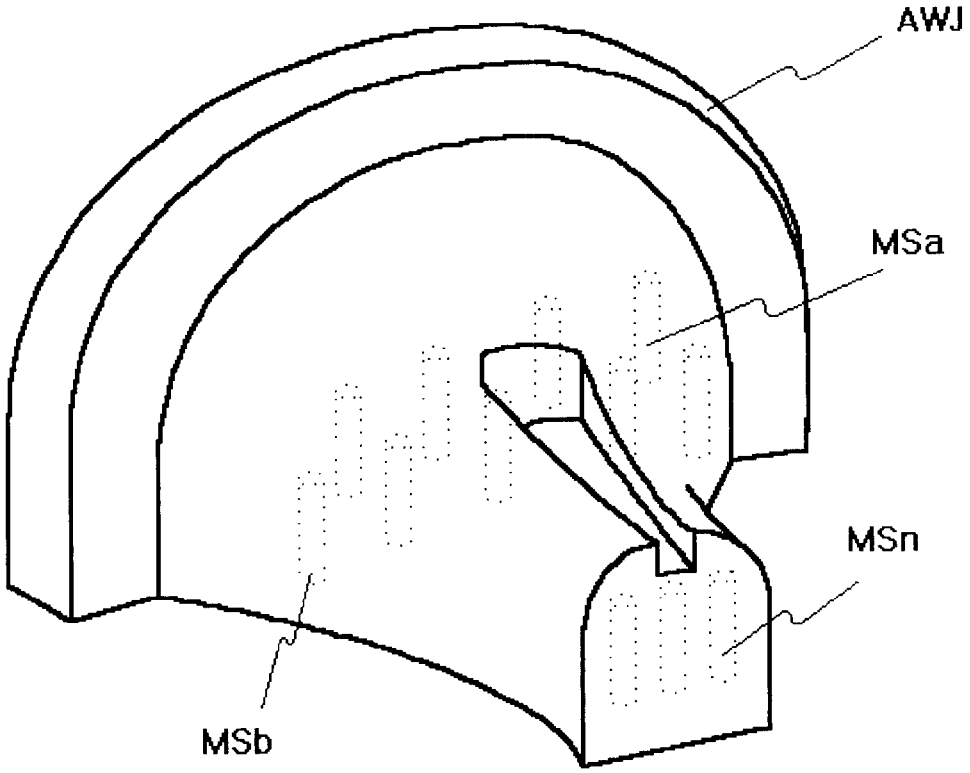
FIG. 5 is a diagram exemplifying an A-shaped winding zig according to the present invention.
Figure 6:
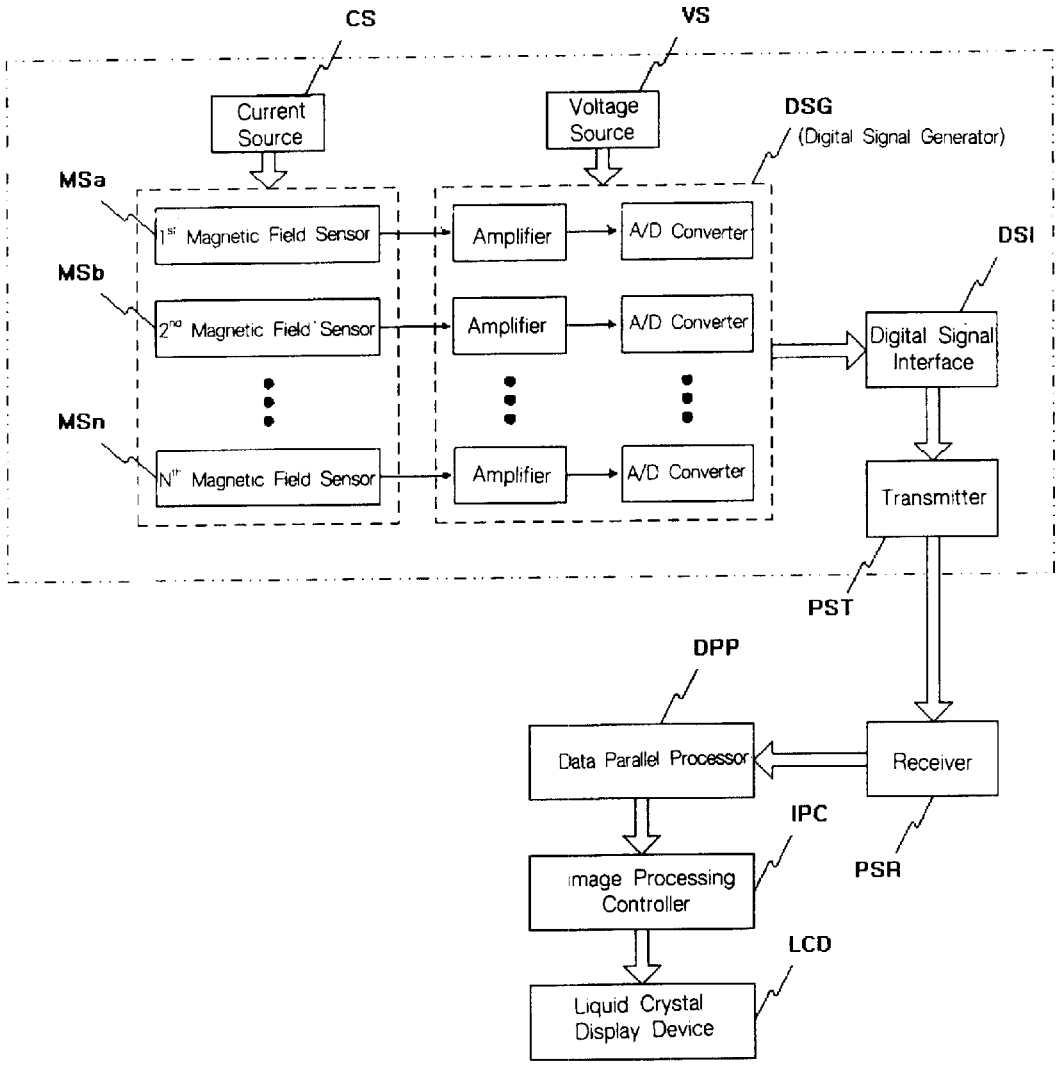
FIG. 6 is a diagram illustrating a construction of a magnetic field measuring system of a deflection yoke according to the present invention.

FIG. 6 shows a basic construction of a magnetic field measuring system employing the winding zig according to the present invention that has magnetic sensors for measuring magnetic fields after winding as shown in FIG. 5.

The construction of the basic system comprises a winding zig, magnetic field sensors mounted inside or outside of the zig, and a control section for processing values measured by the magnetic field sensors. Here, the part blocked by two chain lines in FIG. 6 represents a construction of the winding zig. The other parts represent a construction of the control section.

Thus, the following description will be made by dividing the construction of the magnetic field measuring system into the winding zig and the control section. A detailed construction of the winding zig will first be described herein below.

As shown in FIG. 5, the winding zig comprises magnetic field sensors MSa, MSb, MSn mounted inside of the A-shaped winding zig AWJ, a current source CS for supplying a driving current to operate the magnetic field sensors MSa, MSb, MSn, a digital signal generator DSG, a voltage source VS for supplying a driving voltage to drive the digital signal generator, a digital signal interface DSI for converting the data outputted from the digital signal generator DSG to serial data, and a transmitter PST for receiving and transmitting the signals processed to serial data by the digital signal interface DSI.

Here, it is preferable to realize the transmitter PST into a radio signal transmitter for converting the inputted data to radio signals, and transmitting the converted signals so as to prevent twist of the signal lines.

The digital signal generator DSG comprises amplifiers matched with the respective magnetic field sensors MSa, MSb, MSn mounted on the A-shaped winding zig, and A/D converters matched with each of the amplifiers. No drawing reference numeral was assigned to those constitutional elements.

The following is a detailed description of the construction of the control section.

The control section comprises a receiver PSR for receiving the signals transmitted from the transmitter PST, a data parallel processor DPP for converting the data received by the receiver PSR to parallel data, and processing the converted data by reference to a predetermined index in accordance with an associate relationship between the screen characteristics and magnetic field values, an image processing controller IPC for receiving the data processed by the data parallel processor DPP, and realizing the received data into images of two or three dimensions, and a liquid crystal display LCD device for visually displaying the images of two or three dimensions in accordance with an associate relationship between the screen characteristics and the magnetic field value processed by the image processing controller IPC.

It is preferable to realize the receiver PSR into a radio signal receiver for receiving magnetic field data of a transmitted radio signal type to prevent twist of the transmitted signal lines.

An operation of the magnetic field measuring system according to the present invention will now be described under an assumption that the transmitter and the receiver transmit or receive radio signals.

As shown in FIG. 3 where the A-shaped winding zig in FIG. 5 is attached, a deflection coil is wound by combining the A-shaped winding zig with the B-shaped winding zig. Once the winding is completed, the magnetic field sensors MSa, MSb, MSn sense magnetic field characteristics of the deflection coil wound around the A-shaped winding zig through the driving current supplied by the current source CS.

The output signals of the magnetic field sensors MSa, MSb, MSn are amplified by the amplifiers matched with each of the magnetic field sensors MSa, MSb, MSn, and are converted to digital signals by the A/D converters matched with each of the amplifiers.

The output data from the digital signal generator comprising the amplifiers and the A/D converters are parallel data. Therefore, the digital signal interface receives the parallel data, and converts the same to serial data so as to be transferred to the transmitter PST.

The transmitter PST converts the magnetic field data signals, which have been processed by the digital signal interface into serial data, to radio signals. The reason is because the signal lines for transfer are highly likely to be twisted or shortened when transferring the data through wire by nature of the winding machine. Therefore, it is critical to transfer the data wirelessly, and conversion of the data into serial data is unavoidable.

The following is a description of an operation of the control section corresponding to the winding zig.

The magnetic field measuring data of radio signal type are received by the receiver PSR. The serial data received by the receiver are converted to parallel data by the data parallel processor DPP. Then, an associate relationship between the screen characteristics and the magnetic field characteristics is calculated by reference to a predetermined index, which indicates an influence of the magnetic field characteristics measured by the magnetic field sensors MSa, MSb, MSn onto the screen characteristics.

The data processed by the data parallel processor DPP are received by the image processing controller IPC and displayed by the liquid crystal display device LCD. The image processing controller realizes the influence of the magnetic field characteristics of the winding coil onto the screen characteristics into images of three or two dimensions so as to be easily recognized by a user.

Also, storability of the measured results is enhanced by using a database (not shown in the drawing) or a peripheral device such as a printer.

In short, according to the present invention, a winding machine winds coils by using wires. The coils are formed, and magnetic fields of the coils are measured. The measured values of the magnetic fields are transferred to the control section so as to be displayed on a screen.

Employing a grouping method in accordance with the magnetic field characteristics of the coils serves to reduce dispersion of the screen characteristics. Where a significant managerial point exists in the screen characteristics of a deflection yoke, the coil property values can be totally inspected in association with the point and the magnetic field property values, thereby enhancing quality of the product.

The problem of unbalance between the left and right side characteristics of the deflection yoke can be resolved by checking the difference between the left and right sides through direct measurement of the magnetic field property values of the coils. Therefore, the screen testing time can be reduced with the same effect.

As described above, the magnetic field measuring system according to the present invention is directed to measuring magnetic fields of wound coils in the coil winding system. Measuring the magnetic fields after winding exempts the process of evaluating screen characteristics and improves the existing sampling test to a total inspection for product quality control, thereby realizing an establishment of a system drastically enhancing the product quality.

The magnetic field measuring system according to the present invention also serves to resolve the feasible problem when evaluating the coil characteristics based on the conventional screen characteristics, i.e., the problem caused by failure to accurately evaluate the coil characteristics when based on the screen characteristics, which are the results of complex factors including not only the characteristics of the coil as a unit product but also the assemblability of the coil.

Further, evaluation of characteristics is variable depending on the above factors. Therefore, the magnetic field measuring system provided by the present invention serves to resolve this problem by measuring an extent of the deflecting force that can be generated from the coils by means of magnetic field sensors. Also, the magnetic field measuring system according to the present invention is also expected to enhance the product quality control in the winding process by evaluating the characteristics of the coil as a unit product.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A winding zig for measuring magnetic fields of a deflection yoke, comprising:

a plurality of magnetic field sensors mounted inside of the winding zig;

a digital signal generator for receiving output signals from the magnetic field sensors that sense magnetic field characteristics of a deflection coil wound around the winding zig, amplifying the received signals, and converting the amplified signals to digital signals;

a digital signal interface for converting the data outputted from the digital signal generator to serial date; and a transmitter for receiving signals processed as serial data by the digital signal interface, and transmitting the received signals.

2. The winding zig of claim 1, wherein the digital signal generator comprises:

amplifiers matched with each of the magnetic field sensors mounted in the winding zig for amplifying sensed signals to a predetermined gain, and outputting the amplified signals; and A/D converters matched with each of the amplifiers for converting the amplified signals to digital data.

3. A winding zig for measuring magnetic fields of a deflection yoke, comprising:

a purality of magnetic field sensors mounted inside of the winding zig;

a digital signal generator for receiving output signals from the magnetic field sensors that sense magnetic field characteristics of a deflection coil wound around the winding zig, amplifying the received signals, and converting the amplified signals to digital signals;

a digital signal interface for converting the data outputted from the digital signal generator to serial data; and a transmitter for receiving signals processed as serial data by the digital signal interface, and transmitting the received signals;

wherein the transmitter is a radio signal transmitter for receiving signals processed as serial data by the digital signal interface to prevent twist of signal lines of the transmitted data, converting the received signals to radio signals, and transmitting the converted signals.

4. A winding zig for measuring magnetic fields of a deflection yoke, comprising;

a plurality of magnetic field sensors mounted inside of the winding zig;

a current source for supplying a driving current to operate the magnetic field sensors;

a digital signal generator for receiving the output signals from the magnetic field sensors that sense magnetic field characteristics of a deflection coil wound around the winding zig, amplify the received signals, and converting the amplified signals to digital signals;

a digital signal interface for converting the data outputted from the digital signal generator to serial data;

a transmitter for receiving signals processed as serial data by the digital signal interface, and transmitting the received signals; and a voltage source for supplying a driving voltage for driving the digital signal generator, the digital signal interface and the transmitter.

5. The winding zig of claim 4, wherein the digital signal generator comprises:

amplifiers matched with each of the magnetic field sensors mounted in the winding zig for amplifying sensed signals to a predetermined gain, and outputting the amplified signals; and A/D converters matched with each of the amplifiers for converting the amplified signals to digital data.

6. The winding zig of claim 4, wherein the transmitter is a radio signal transmitter for receiving signals processed as serial data by the digital signal interface to prevent twist of signal lines of the transmitted data.

7. A magnetic field measuring system of a deflection yoke, comprising:

a plurality of magnetic field sensors mounted inside of the A-shaped winding zig;

a digital signal generator for receiving output signals from the magnetic field sensors that sense magnetic field characteristics of a deflection coil wound around the A-shaped winding zig, amplifying the received signals, and converting the amplified signals to digital signals;

a digital signal interface for converting the data outputted from the digital signal generator to serial data;

a transmitter for transmitting signals processed as serial data by the digital signal interface, and transmitting the received signals;

a receiver for receiving the magnetic field measuring data transmitted by the transmitter;

a data parallel processor for receiving the data received by the receiver, converting the received data to parallel data, and processing the converted data by reference to a predetermined index in accordance with an associate relationship between screen characteristics and magnetic field values; and a display device for visually displaying the data processed by the data parallel processor to an inspector or a worker.

8. The magnetic field measuring system of claim 7, wherein the transmitter is realized into a radio signal transmitter for receiving signals processed as serial data by the digital signal interface to prevent twist of signal lines of the transmitted data.

9. The magnetic field measuring system of claim 7, wherein the receiver is realized into a radio signal receiver for receiving magnetic field data of the transmitted radio signal type when the transmitter is used as a radio signal transmitter to prevent twist of signal lines of the transmitted data.

10. A magnetic field measuring system of a deflection yoke, comprising:

a plurality of magnetic field sensors mounted inside of the A-shaped winding zig;

a digital signal generator for receiving output signals from the magnetic field sensors that sense magnetic field characteristics of a deflection coil wound around the A-shaped winding zig, amplifying the received signals, and converting the amplified signals to digital signals;

a transmitter for transmitting signals processed as serial data by the digital signal interface, and transmitting the received signals;

a receiver for receiving the magnetic field measuring data transmitted by the transmitter;

a data parallel processor for receiving the data received by the receiver, converting the received data to parallel data, and processing the converted data by reference to a predetermined index in accordance with an associate relationship between screen characteristics and magnetic field values;

an image processing controller for receiving the data processed by the data parallel processor, and realizing the received data into images of three or two dimensions; and a display device for visually displaying the images of three or two dimensions processed by the image processing controller in accordance with an associate relationship between the screen characteristics and the magnetic field values to an inspector or a worker.

11. The magnetic field measuring system of claim 10, wherein the transmitter is realized into into a radio signal transmitter for receiving signals processed as serial data by the digital signal interface to prevent twist of signal lines of the transmitted data.

12. The magnetic field measuring system of claim 10, wherein the receiver is realized into a radio signal receiver for receiving magnetic field data of the transmitted radio signal type when the transmitter is used as a radio signal transmitter to prevent twist of signal lines of the transmitted data.

13. An improved deflection yoke assembly, including a winding zig having a deflection coil wound around it, the improvement permitting measurement of magnetic fields produced by the deflection coil and comprising:

a plurality of magnetic field sensors mounted in positions to sense substantially only the magnetic field characteristics of the deflection coil, to produce sensor output signals representative of the magnetic field characteristics; and a transmitter transmitting an information signal representing the sensor output signals.

14. The deflection yoke assembly of claim 13 wherein the transmitter is a wireless transmitter.

* * * * *